United States Patent [19]

Kimura et al.

[11] Patent Number: 4,851,098

[45] Date of Patent: Jul. 25, 1989

[54] APPARATUS FOR HANGING AND HANDLING PLATE MEMBERS

[75] Inventors: Takeo Kimura; Yoshiatsu Seki; Mitsuru Ohkoda; Makoto Hosaka, all of Akita, Japan

[73] Assignee: Mitsubishi Kinzoku Kabushiki Kaisha, Tokyo, Japan

[21] Appl. No.: 179,402

[22] Filed: Apr. 8, 1988

[30] Foreign Application Priority Data

Apr. 10, 1987 [JP] Japan ..... 62-87105
Oct. 6, 1987 [JP] Japan ..... 62-250711

[51] Int. Cl.[4] ..... C25D 17/00; C25D 17/04; C25D 17/06

[52] U.S. Cl. ..... 204/198; 204/225; 204/297 R; 414/626

[58] Field of Search ..... 204/198, 225, 297 R; 414/618, 626

[56] References Cited

U.S. PATENT DOCUMENTS 3,562,131 2/1971 Jasberg ..... 204/198
4,028,211 6/1977 Hirakawa et al. ..... 204/225 X
4,326,937 4/1982 Neumeier et al. ..... 204/225 X
4,382,848 5/1983 Kosonen ..... 204/225 X
4,436,606 3/1984 Viellefont et al. ..... 204/225

*Primary Examiner*—Donald R. Valentine
*Attorney, Agent, or Firm*—Oblon, Spivak, McClelland, Maier & Neustadt

[57] ABSTRACT

The apparatus of this invention is an apparatus for hanging and transferring a plurality of plate members, is provided with a plurality of hanger members, which are slidable along a supporting frame therefor and are able to space apart or bring together the hanging plate members. Therefore, when this apparatus is used for handling of electrode plates in electrowinning of a metal, the electrode plates can be subjected to various treatments in the spaced-apart condition or the brought-together condition as desired as being hung therefrom. Thus the treatments of the electordes can be efficiently effected. The apparatus can be provided with clamp means which bring the hanging plate members together, and tightly assemble them. The thus assembled electrode plates can be immersed in an electrolytic cell as a set, which improves the efficiency of the electrowinning process.

10 Claims, 15 Drawing Sheets

APPARATUS FOR HANGING AND HANDLING PLATE MEMBERS

FIELD OF THE INVENTION

This invention broadly relates to an apparatus for hanging and handling a plurality of plate members. More particularly, this invention relates to an apparatus suitable for lifting a plurality of electrode plates out of an electrolytic cell, transferring them to various working stations and then returning them to the electrolytic cell.

BACKGROUND OF THE INVENTION

Cranes and hoists are generally used for hanging and/or transferring various bodies in various fields. However, it is not convenient to use a conventional crane or hoist for lifting and transferring electrode plates in the electrowinning or electrolic refining of metals, since there are various problems as outlined below.

Hereinafter in this specification, the term "electrowinning" is used as including "electrolytic refining".

In the electrowinning of metals, a plurality of anodes and cathodes are alternatively arranged at predetermined intervals in an electrolytic cell. These electrodes are lifted and many of them are serviced, treated, changed or renewed before or after the operation. In the electrowinning of zinc, for instance, the cathodes are taken out of the electrolytic cell and transferred to the stripping operation for recovering electrodeposited zinc, and thereafter they are again returned to the cell. The anodes are serviced and repaired if necessary after every several runs.

As mentioned above, a crane or hoist has been used for lifting and transferring electrodes. And hanging means are used for simultaneously lifting and facilitating servicing and changing of a plurality of electrodes, said means being provided with hooks which catch and pick up electrodes. The conventional hanging means are provided with hooks spaced at constant intervals, and the distance between the hooks cannot be varied. Therefore, the electrodes are carried in the closely spaced state to the stripping station. With such small a space between the electrode plates, the scraping operation is very troublesome. It would be very advantageous if the space between the electrode plates could be widened as desired. The conventional electrode-lifting means hang only electrodes of one kind, and are not provided with insulating means. Therefore, it is impossible to simultaneously lift electrodes of the different kinds by a conventional lifting means, because short-circuiting occurs.

DISCLOSURE OF THE INVENTION

The present invention solves the above-described problems by providing a framework provided with a hanger structure which are provided with a plurality of hangers which can sling electrode plates and are movable.

Broadly, this invention provides an apparatus for hanging, transferring, separating apart, bringing together or releasing a plurality of plate members comprising a travelling framework with a driving means therefor; a hanger structure which is mounted on the framework, hangs a plurality of plate members, and is movable up-and-down; said hanger structure comprising a hanger-supporting frame, a plurality of hangers which are supported on the hanger-supporting frame and move along the hanger-supporting frame, driving means for moving the hangers, and hook means which are pivotably connected to each hanger and pick up the plate members.

In a preferred embodiment of the present invention, a plurality of hangers are movably mounted on rails laid on the hanger-supporting frame, the hangers are serially connected by means of link means so that the linked hangers can be expanded, contracted or moved as a whole by means of the hanger-driving means; and there are outside hangers and inside hangers, the outside hangers have legs on both ends, thus the outside hangers can encompass the inside hangers and thus the inside hangers can move through the space defined by the outside hangers.

In a preferred embodiment, the apparatus of the present invention is provided with at least a pair of spaced and confronting clamp arms for clamping plate members. The clamp arms are pivotably connected to the underside of the hanger-supporting frame at their base ends and open and close in the direction of the thickness of the plate members and can bring together the plate members and tighten them when they are rotated by their driving means.

In a preferred embodiment, the apparatus of the present invention is provided with a pair of confronting holder arms extending in the direction of the plane of the plate members and a driving means therefor. Each holder arm is pivotably secured to one of the hanger supporting frame beams at its base end. The other end thereof can detachably hold a clamp bar. When the holder arms are rotated by the driving means toward the plate members, which have been brought together by the clamp arms, the holder arms can cause the clamp bars to hold the edges of the bundle of the plate members.

Hereinafter, we simply call the apparatus of this invention an apparatus for handling plate members.

The apparatus for handling plate members of the present invention comprises a framework which can travel and a hanger structure which can hang a plurality of plate members.

The framework has the shape of a transversely long gate and having some depth in the traveling direction. The travelling of the framework can be effected by any means, manually for instance, although it is usually driven electrically. The framework can be suspended from the rails fixed to the ceiling of a plant building or can travel on rails laid on the floor of the plant. In the case where the apparatus handles electrode plates, the framework straddles an electrolytic cell.

The framework includes a hanger structure therein. The hanger structure comprises a hanger-supporting frame which is supported by the framework so that the up-and-down motion is possible. The hanger-supporting structure movably supports a plurality of hangers. For instance, the hanger-supporting structure is provided with a pair of guide rails on which the hangers are slidably mounted. Or otherwise, the hangers may be suspended from the rails. A plurality of hangers are serially linked by means of links, and means for moving the linked hangers toward one end or the other end of the hanger-supporting frames are provided. Thus the linked hangers can be moved together as a whole, expanded or contracted. These means can be two chain mechanisms which separately move to draw the hangers along the rails or otherwise can be linear motors formed between the hangers and the hanger-supporting frames.

Each hanger is provided with hook means which sling a plate member. The structure of the hook means is not specifically limited, but they are preferably a pair of hooks suspended from both ends of a hanger which catch protrusions of a plate member.

Preferably, two kinds overlappable alternately-placed of hangers are provided so that they can pick up plate members closely spaced from each other. That is to say, outside hangers and inside hangers are provided. The outside hanger has legs on both ends thereof and has a gate-like shape so that it can encompass an inside hanger between the two legs. Thus the inside hangers can move through the space defined under the gate-like outside hangers.

When the apparatus of the present invention is to be used for handling electrode plates for an electrolytic cell, it will be convenient if the outside hangers sling only the cathodes and the inside hangers sling only the anodes (or vice versa).

In a preferred embodiment of the present invention, the apparatus can be provided with clamp means for handling a plurality of plate members as a whole.

Such clamp means comprises at least a pair of confronting clamp arms and driving means therefor. The base end of each clamp arm is pivotably secured to the underside of the beam of the hanger-supporting frame, on which the guide rails are laid, and inside of the hooks extending downward from the hanger, and the other end thereof extends downward and is swingable in the direction of the thickness of the plate members. That is, the pair of clamp arms are provided at positions where they do not interfere with the movement of the hangers. Thus the clamps can bring the hanging plate members together and tighten them when rotated by the above-mentioned driving means. This clamp means can be driven by any means including hydraulic cylinder, although electrically-operated cylinder mechanism is preferred.

The clamp arms stand by under the hanger-supporting frame therealong at the time when the hangers move and start the clamping motion driven by the driving means when the plate members are brought together by the operation of the hangers.

In a preferred embodiment of the present invention, the apparatus is further provided with a mechanism which bundles a plurality of plate members brought together by means of clamp bars. This mechanism comprises at least a pair of confronting holder arms which are provided in the direction perpendicular to the direction of the clamp arms, that is, in the direction of the plane of the plate members in the vicinity of the clamp arms. The base end of each thereof is pivotably secured to the hanger-supporting frame outside of the movement range of the hangers. The distal end detachably holds a clamp bar. The pair of the holder arms stand by opened sideward under the hanger-supporting frame. After a plurality of plate members are brought together by the clamp arms, the holder arms move toward the bundle of plate members driven by said driving means, and cause the clamp bar to press the edges of the plate members. Thus the edges of the plurality of plate members are flushed and the plate members are bundled together. Then the holder arms release the clamp bars, which retract upward to the stand-by positions.

The apparatus for handling plate members provided with the hanger structure and a clamp structure in accordance with the present invention can suitably be used for handling electrode plates in electrolytic cells as explained below.

The framework travels astride an electrolytic cell or cells and temporarily halts at one predetermined electrolytic cell. At this time, the anode plates and the cathode plates are alternately arranged with a narrow space maintained therebetween by means of a spacer or a frame supported by clamp bars and are immersed in the electrolytic cell. Of course, one end of the cross bar of each anode plate and cathode plate is in contact with a respective bus bar and the other end is insulated. The hanger structure is designed so that the space between the hook of an outside hanger and the hook of an adjacent inside hanger is the same and equal to the space between an anode plate and a cathode plate when the linked hangers are in the most contracted state. Then the hanger-supporting frame is lowered and the hooks of the hanger catch the ears (protrusions) of the electrode plates, and the hanger structure is lifted together with the electrodes. The holder arms move downward to hold the clamp bars and detach them from the bundle of the electrode plates and return to the stand-by position.

Before, during or after the travelling of the framework, the electrode plates are widely spaced apart by the movement of the hangers. Under this condition, the electrode plates are subjected to various treatments, stripping, servicing, repair, etc. Thereafter, the hangers are drawn together to the approximately central position. After the clamp arms and the holder arms operate to bring the electrode plates tightly together and the electrode plates are bundle integrally by the clamp bars, the hanger-supporting frame is lowered to immerse the set of the electrodes in the electrolytic cell. The hanger-supporting frame is then lifted and the linked hangers are moved to the other part of the same electrolytic cell or another electrolytic cell by themselves or together with the framework if required.

The apparatus of the present invention can lift a plurality of plate members closely arranged side by side, space them apart as desired, and bring them together again. Handling of the electrode plates is easy and the aparatus enables a set of arranged electrode plates to be applied to a separate electrolytic cell. Also interelectrodes intervals can be selected as desired.

The apparatus of the present invention can accurately pick up closely spaced electrode plates, and immerse the electrodes at an accurate position in the electrolytic cell. Therefore, it makes it possible to arrange the elelctrode plates very closely to achieve high efficiency electrolysis.

The apparatus of the present invention can lift the anode plates and cathode plates simultaneously without cutting of electric current. Therefore both cathodes and anodes can be simultaneously treated or serviced. That is, the treatments of the cathodes and the anodes can be simultaneously effected during one to-and-fro movement of the apparatus, since the distance between a cathode and an anode can be widely spaced. Thus the operation time can greatly be shortened.

The apparatus of the present invention enables automation of the whole electrowinning process, since sequential operation of conveyance of electrode plates for immersion, lifting and lowering of electrodes, stripping of deposited metal, polishing and surfacetreatment, etc. of electrodes is made possible by this apparatus.

Application of the apparatus of the present invention is not limited to handling of electrode plates in the electrowinning of metals but the apparatus is generally applicable to cases where a plurality of closely arranged plate members are simultaneously lifted, spaced apart for any treatment or transferred to another position.

BRIEF DESCRIPTION OF THE ATTACHED DRAWINGS

DETAILED DESCRIPTION OF THE PREFERRED EMBODIMENT

A preferred embodiment of the present invention is illustrated in the attached drawings.

Figure 1:
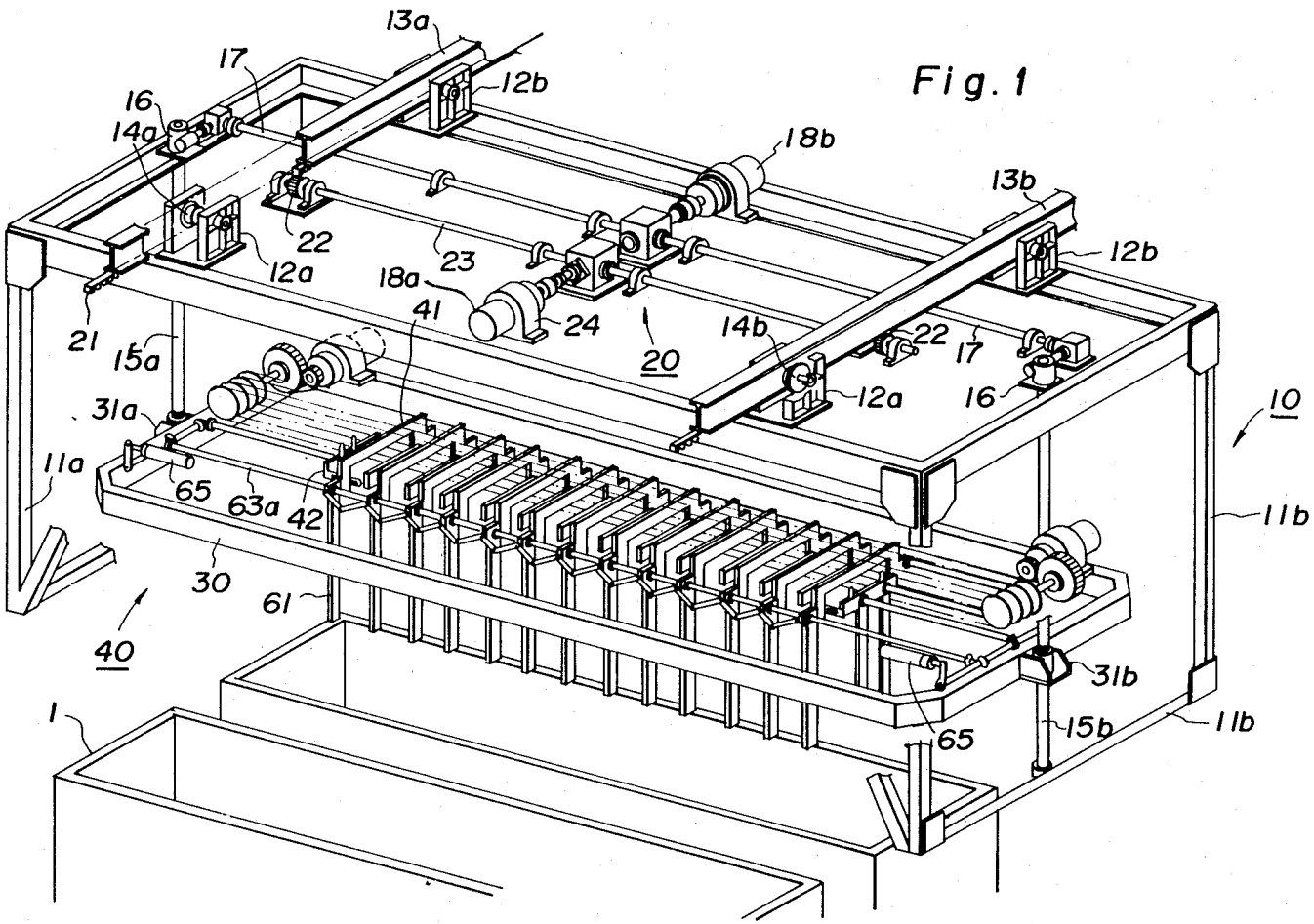
FIG. 1 is an overall perspective view of the apparatus of an embodiment of the present invention wherein some details are omitted.
Figure 2:
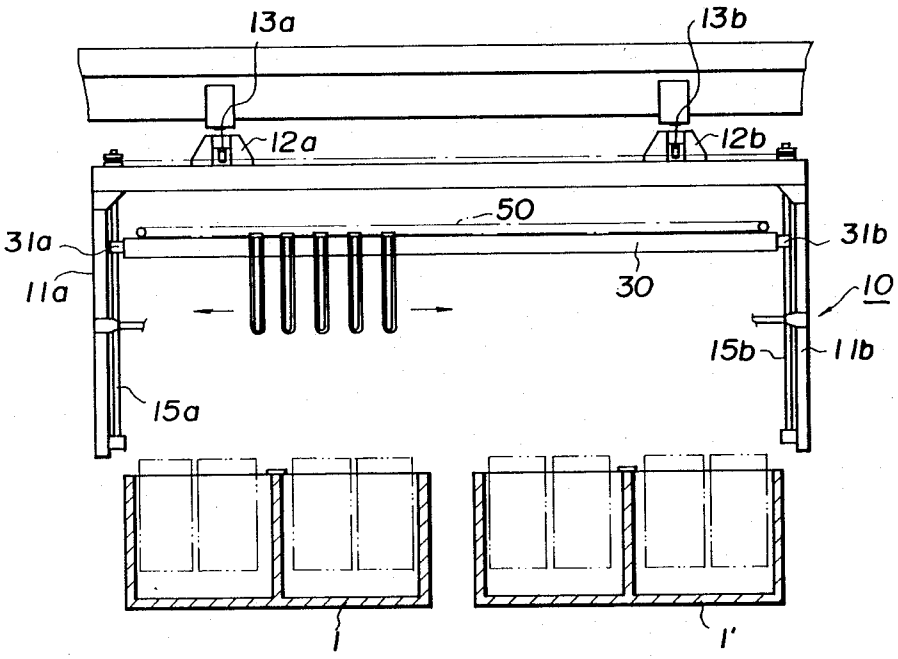
FIG. 2 is an elevational view of the apparatus of FIG. 1. wherein only pertinent members are shown.

An apparatus for handling electrode plates comprises a framework 10 which travels astride a rectangular electrolytic cell or cells 1, 1' driven by a driving mechanism 20 which is secured to the framework at a beam (not shown) (FIGS. 1 & 2). As shown in FIG. 1, the framework is a gate-like structure which is transversely long and has some depth in the travelling direction. Two pairs of suspending means 12*a*, 12*b* are secured to beams (not shown). The framework is movably suspended from a pair of rails 13*a*, 13*b* fixed to the ceiling of the plant building by means of the suspending means. The suspending means 12*a*, 12*b* are provided with supporting rollers 14*a*, 14*b* which rotate in contact with the rails. Thus the framework can travel over the electrolytic cell along the rails 13*a*, 13*b*. The framework can be designed so that the transverse length thereof is far longer than the length of the electrolytic cell and can straddle two or more electrolytic cells.

Figure 3:
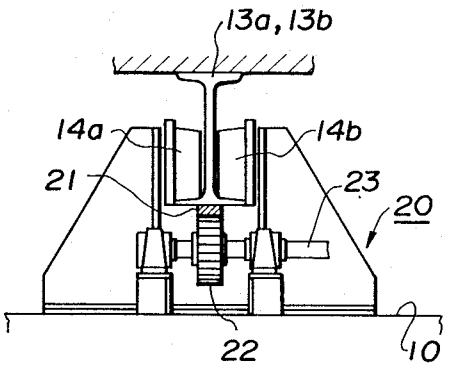
FIG. 3 is a partial elevational view showing the suspension means and a part of driving means for travelling of the apparatus.

Each rail 13*a*, 13*b* is provided with a rack 21 on the underside surafce thereof. Pinions 22 which engage with the racks of the rails are secured to a rotating shaft 23 which is driven by a driving means secured on a beam (not shown) (FIGS. 1 and 3). The shaft 23 is rotated by a motor 18*a* which is secured to the beam (not shown) by means of fixing means 24. The rack and pinion can alternatively be provided on the side surface of the rails. In the apparatus of this embodiment, the suspending means and the driving means are separately provided, which is helpful for preventing slipping and/or rolling motion during travelling and thus enables the framework to stop at a very precise position. That is, the rack and pinion mechanism does not allow slipping and the supporting rollers 14*a*, 14*b* serve to prevent rolling motion.

In order to stop the framework precisely at a predetermined position, a linear motor can be employed as a driving and travelling means as explained in detail later. The framework can be designed so that it travels on the rails laid on the floor instead of being suspended from the overhead rails.

For controlling the travelling velocity and halting positions of the framework, generally known measures can be employed. For instance, sensors are provided at suitable positions and rotation of the driving motor is controlled and a dynamic brake is actuated by the signals generated by the sensors.

Figure 4:
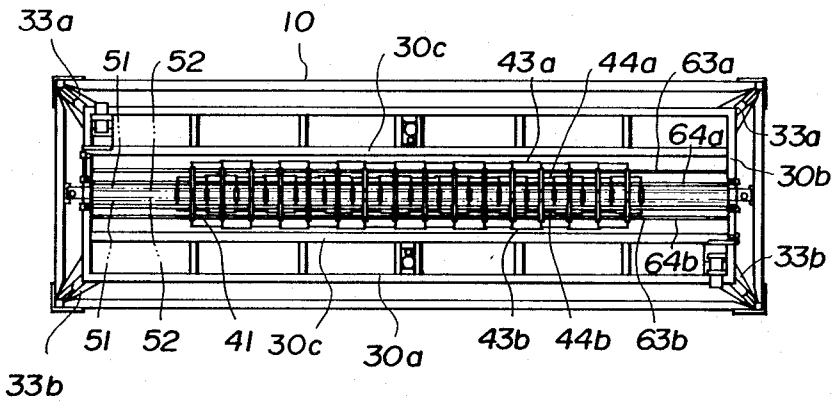
FIG. 4 is a plain view of the hanger structure of the apparatus of FIG. 1.

The hanger structure 40 comprises a hanger-supporting frame 30 which bears a plurality of hangers 41 and 42 (FIGS. 1 and 4). The hanger-supporting frame 30 is a rectangular frame comprising two pairs of parallel beam members 30*a*, 30*a*; 30*b*, 30*b*, which is supported by a pair of screw shafts 15*a*, 15*b* secured to the side frames of the framework 10. That is, the hanger-supporting frame 30 extends transversely and is provided with a nut means 31*a*, 31*b* at the center of each side beam. The nut means engage with the screw shafts 15*a*, 15*b* and thus the hanger-supporting frame can be lifted or lowered by the rotation of the shafts 15*a*, 15*b*. The upper ends of the screw shafts are connected to a driving shaft 17 secured to a beam (not shown) via bevel gear means. The driving shaft 17 is rotated by a driving motor 18*b*. At the four corners of the hanger-supporting frame, guide protrusions 33*a*, 33*b* (FIG. 4) are provided so as to contact the corner pillars of the framework 10. Thus the hanger-supporting frame 30 is lifted or lowered driven by the screw shaft and guided by the corner pillars. Needless to say, the two shafts 15*a*, 15*b* are synchronously rotated.

Of course, instead of the screw shafts, suspending wires, hydraulic cylinders, etc. can be used as the lift means. However, the shaft means is more advantageous in that control of the halting position, moving velocity, swinging motion, etc, is easier. The lift mechanism is conveniently provided with a mechanism which stops the hanger-supporting frame at several predetermined levels. Such a mechanism has sensors provided at the halting positions, which generate signals to be transmitted to the driving motor 18 to stop it.

Figure 5A:
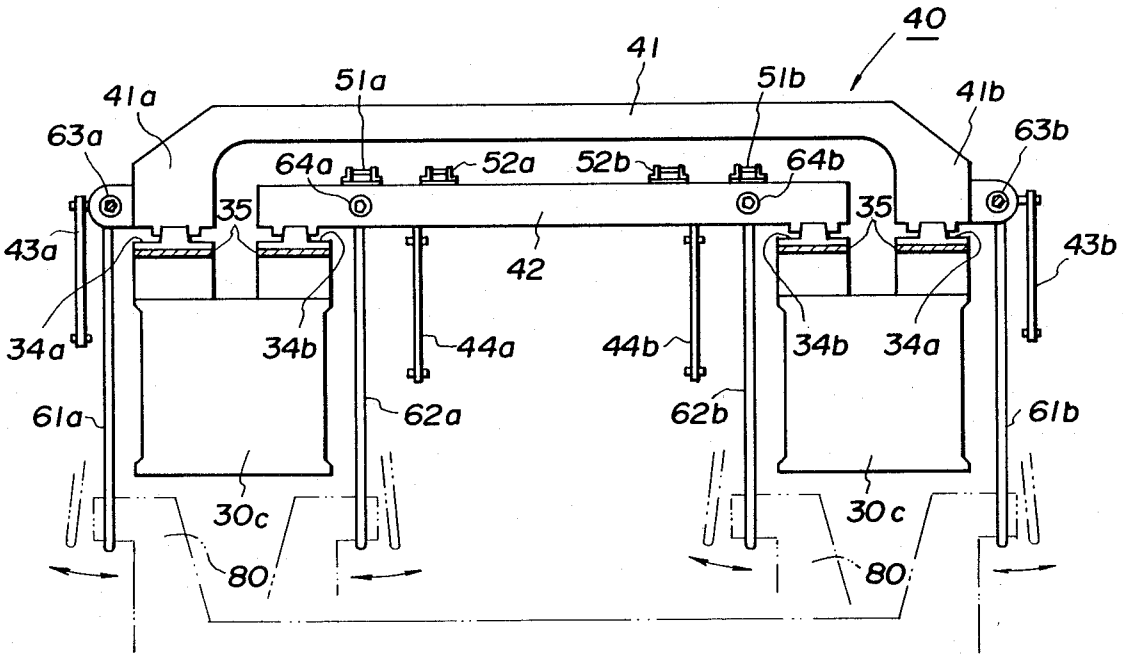
FIG. 5A is a partly cross-sectional side elevational view showing the hangers.
Figure 6:
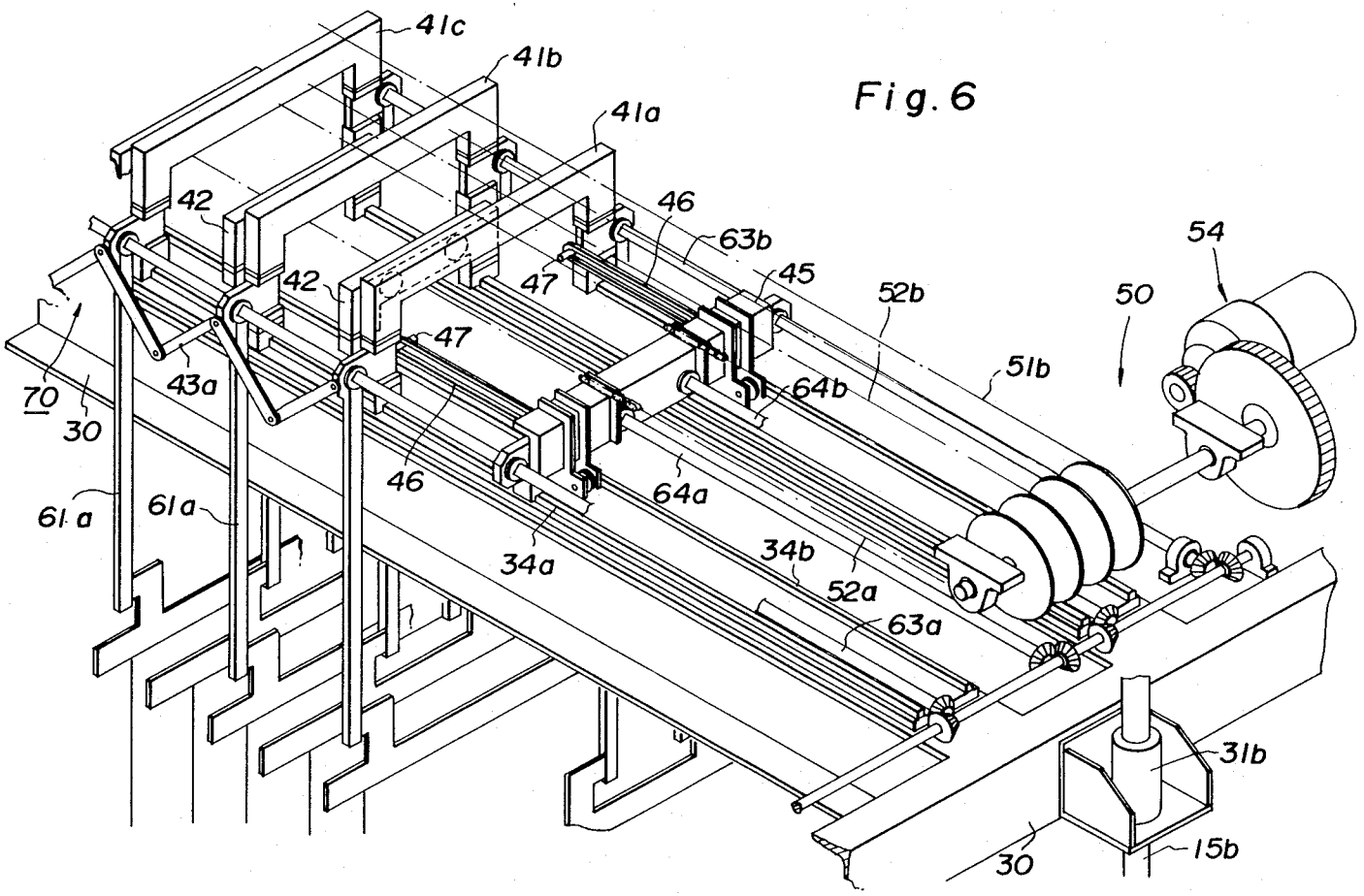
FIG. 6 is a partial perspective view showing the hanger structure.

The hanger-supporting frame 30 is provided with guide rails 34*a*, 34*b* in the transverse direction (FIGS. 5A & 6). Hangers 41, 42 for hanging electrode plates are slidably mounted on the guide rails 34*a*, 34*b*. The hangers move along the guide rails 34*a*, 34*b* and they can be spaced apart in the transverse direction or brought together.

Figure 7:
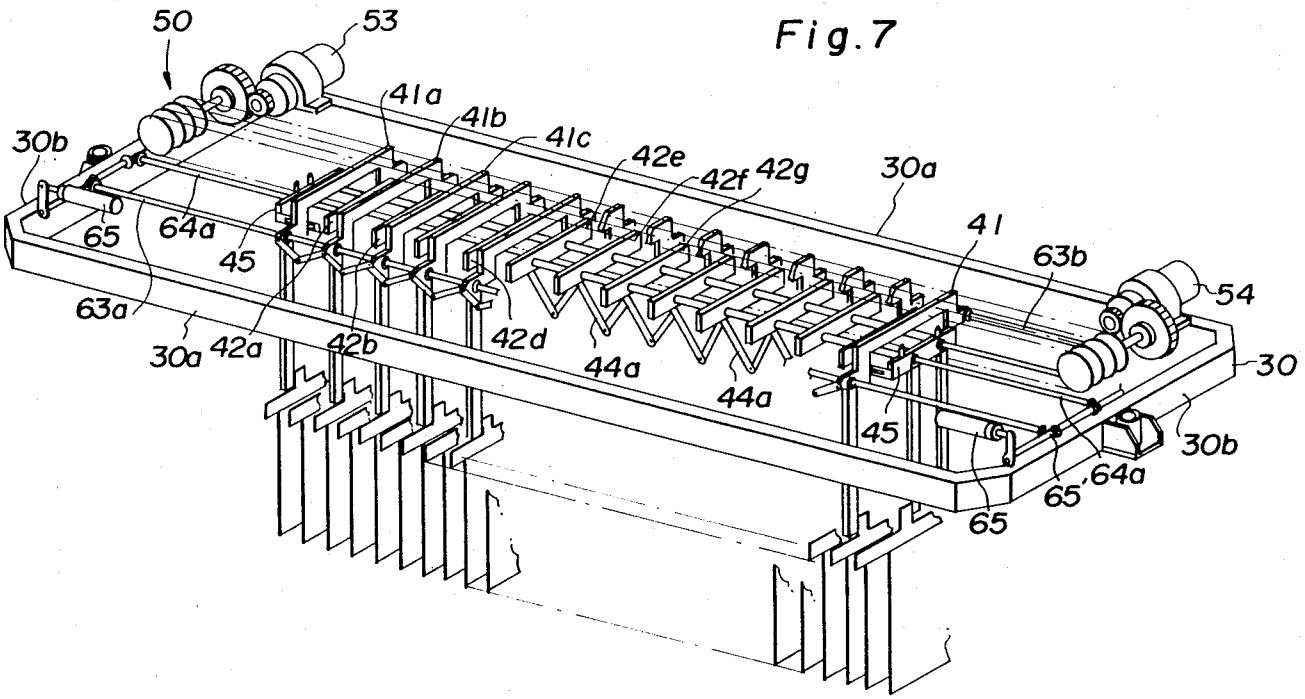
FIG. 7 is a partial perspective view showing the arrangement of the hangers.
Figure 8:
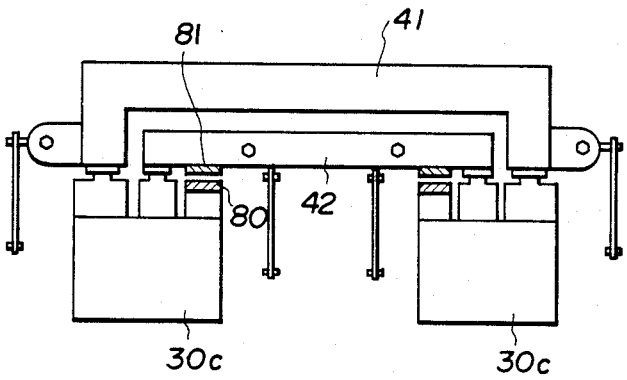
FIGS. 8 and 9 are schematic presentations showing hangercarrying means using linear motors.
Figure 9:
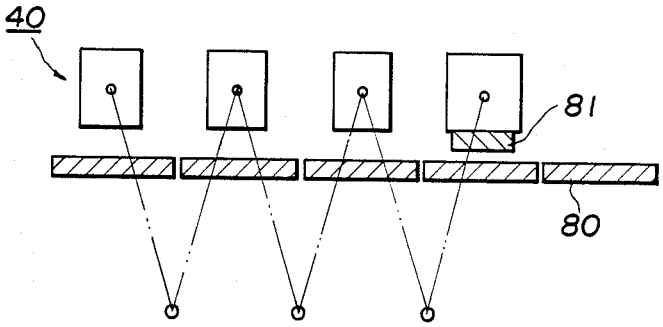

As shown in FIGS. 5A and 7, there are outside hangers 41 and inside hangers 42. For instance, the outside hangers hang cathodes and the inside hangers hang anodes. The outside hangers 41 have legs 41*a*, 41*b* at both ends. The legs form sliding shoes. Both ends of the inside hangers 42 form sliding shoes per se. Thus the outside hangers straddle the inside hangers. The guide rails 34*a*, 34*b* are provided parallel on the beams 30*c* respectively corresponding to the outside hangers and the inside hangers. Insulating members 35 are sandwitched between the guide rails 34*a*, 34*b* and the hanger-supporting beams 30*c*, and, therefore, the anodes and the cathodes can be lifted simultaneously without short circuiting.

Figure 5B:
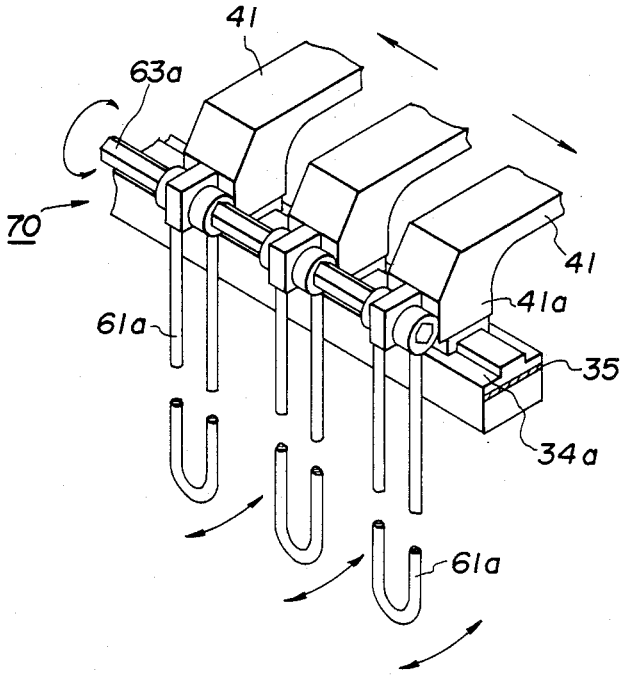
FIG. 5B is a partial perspective view of hook means of the hangers.

Each hanger 41, 42 is provided with hook means 61*a*, 61*b*; 62*a*, 62*b* as shown in FIGS. 5A, 5B and 6. The hook means is a U-shape suspending member and each hanger has a pair of hooks. The lower end of the hook member extends so that it can catch the ear 80 of a cross bar of an electrode plate.

The hook members are provided with a tilting mechanism 70 as shown in FIG. 5B. The tilting mechanism 70 comprises, for instance, a rotatable polygonal rod 63*a*, 63*b*; 64*a*, 64*b* which extends to penetrate through the end portion of the hangers 41, 42 and a hole means slidably engageable with said polygonal rod provided at the upper portion of the hook member. The example shown in FIGS. 5A and 5B is a pentagonal rod and a pentagonal hole. A pair of rotatable rods are provided each hanger and the pair of rods synchronously rotate in opposite directions. Therefore, a pair of hook members are tilted oppositely, that is, the lower ends of the pair of hook members open or close. Of course, the rods are insulated. The rotatable rods are rotated by a cylinder mechanism 65 provided at the ends of the hanger-supporting meams via bevel gears as shown in FIG. 7. The rotatable rods 63*a* etc. are not necessarily polygonal but it may be elliptic. Or otherwise, the rod is cylindrical with a groove which receives a key means provided in the hook member. Any mechanism which can cause rotation will do. The tilting mechanisms can be a small actuator provided on each hanger. However, the abovedescribed rotatable rod is simple and convenient. Of course a mechanism which controls the tilting of the hook members is provided. This can also comprise sensors as described above.

The above-described hanger system is provided with driving mechanism 50 for moving hangers. An example thereof is chain mchanisms as shown in FIGS. 6 & 7. On the upper side of the hanger-supporting frame 30, two pairs of endless chains 51*a*, 51*b*, 52*a*, 52*b* are set up in the transverse direction between sprocket wheels (FIG. 6), which are driven by driving means 53 and 54. One pair of chains move in the opposite directions from the other. The outside hangers 41*a*, 41*b*, 41*c* . . . are linked with connecting links 43*a*, 43*b*, 43*c* . . . (FIG. 7). The inside hangers 42*a*, 42*b*, 42*c*, . . . are also linked together with connecting links 44*a*, 44*b*. The end one of the outside hangers is a tractive hanger 45, which simultaneously works as an inside hanger. That is, the end outside hanger 45 is provided with the same hook members as those of the inside hanger and is linked with an adjacent inside hanger by means of a link and is also linked with the adjacent outside hanger 41 by means of a connecting arm 46 having a slot. Th length of the slot is the same as the length of a link piece. The slot engages with a protrusion 47.

As has been explained, two linkages 43*a*, 43*b* of the outside hangers and linkages 44*a*, 44*b* of the inside hangers are formed, and the linkages 43*a*, 43*b*, and the lingkages 44*a*, 44*b* are connected with each other by the two end tractive hangers 45. The tractive hangers are respectively connected to the chain 51*a*, 51*b* and 52*a*, 52*b*.

When the chains 51*a*, 51*b* and 52*a*, 52*b* draw the end tractive hangers 45 each outward, that is, toward the end of the hanger-supporting frame, the linked hangers 41, 42 are spaced apart until the adjacent hangers are moved apart by the length of a pair link pieces. On the other hand, when the chains 51*a*, 51*b* and 52*a*, 52*b* draw the end tractive hanger toward the center of the hanger-supporting frame, the linked hangers 41, 42 are brought together. In this case, the distance between an outside hanger and the adjacent inside hanger is designed so that it is equal to the space between an anode plate and the adjacent cathode, which are driven by driving mechanisms 53, 54. Also, the hangers brought together can be moved in one direction en bloc.

When the electrode plates are to be recovered from the electrolytic cell, the framework 10 stands still at the predetermined electrolytic cell. The hanger-supporting frame 30 in which the hangers have been brought together at the predetermined position is lowered so that the hooks thereof reach the ears of the electrode plates. The rotation rods 63*a*, 64*b* rotate to tilt the hooks of the hangers to catch the ears of the electrode plates. Thereafter, the hanger-supporting frame 30 is lifted and is moved to an electrodetreatment station together with the framework 10. During this travelling, the chain mechanisms 51 and 52 drive the plurality of the hangers 41, 42 so as to space them apart. At the electrode treatment station, servicing, repairing, cleaning, etc. of the anodes and stripping of the deposited metal from the cathodes, polishing of the cathodes, etc. are conducted. After such treatments have been finished, the framework 10 will be moved to the other of the same electrolytic cell or another electrolytic cell, during which the chains 51, 52 drive the hangers 41, 42 to bring them together. When the framework arrives at the intended electrolytic cell, the hanger-supporting frame is lowered so as to place the electrode plates in the cell and release them. The hanger-supporting frame is again lifted and moved to another electrolytic cell if required.

FIGS. 10–18 show an apparatus for handling electrolytic cells provided with electrode-clamping devices. The framework 10, the driving means therefor 20, the hanger structure 40, the driving mechanism 50 for the hangers 41, 42, the hook mechanism 60, etc. are entrely the same as described above.

Figure 13:
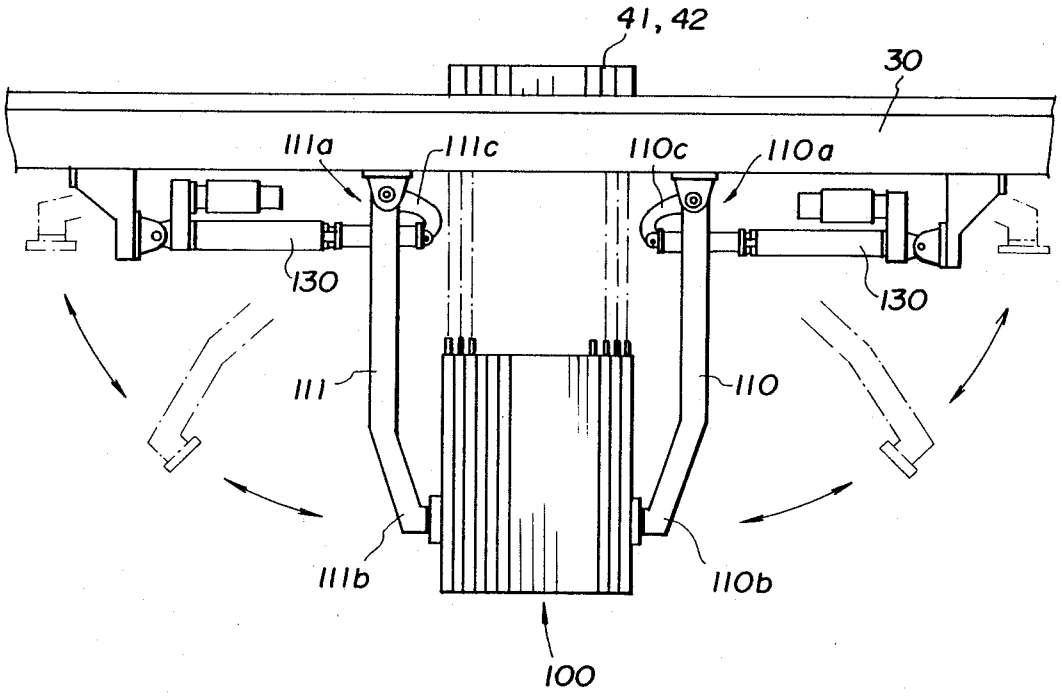
FIG. 13 is a partial elevational view showing the first clamp means (clamp arms).

In this embodiment, two pairs of clamp arms 110, 111 and a pair of holder arms 120 are provided on the underside of the hanger-supporting frame 30 at the approximate center of the frames. A pair of clamp arms 110 and 111 are sucured to the underside surface of a frame of the hanger-supporting frame as shown in FIG. 13. The base ends of the clamp arms 110*a* and 111*a* are pivotably secured to the frame, and each rotating shaft thereof is connected to a cylinder mechanism 130 secured to the frame 30 via a connecting rod 110*c* or 111*c*. The other ends of the clamp arms 110*b* and 111*b* are extend downward and bent toward the electrode plates 100. These pairs of the clamp arms are located at the same position in each beam and are arranged symmetrically, and they are positioned between the hooks 61*a* or 61*b* of the outside hangers and the hooks 62*a* or 62*b* of the inside hangers so as not to hinder the movement of the hangers 41, 42 (FIG. 5).

Figure 10:
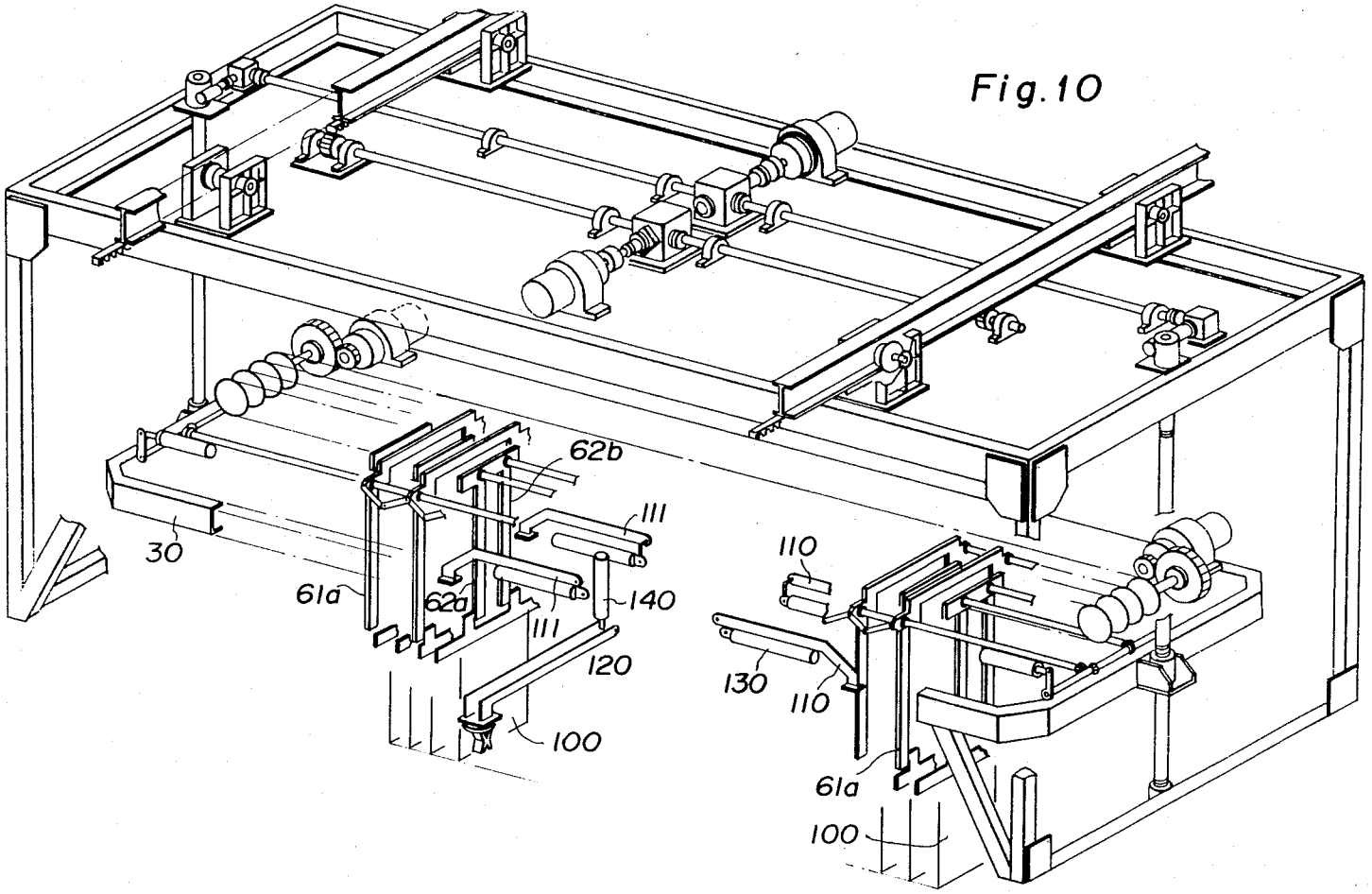
FIGS. 10 to 12 are partial perspective views of the apparatus of FIG. 1 in which clamp means are provided.
Figure 11:
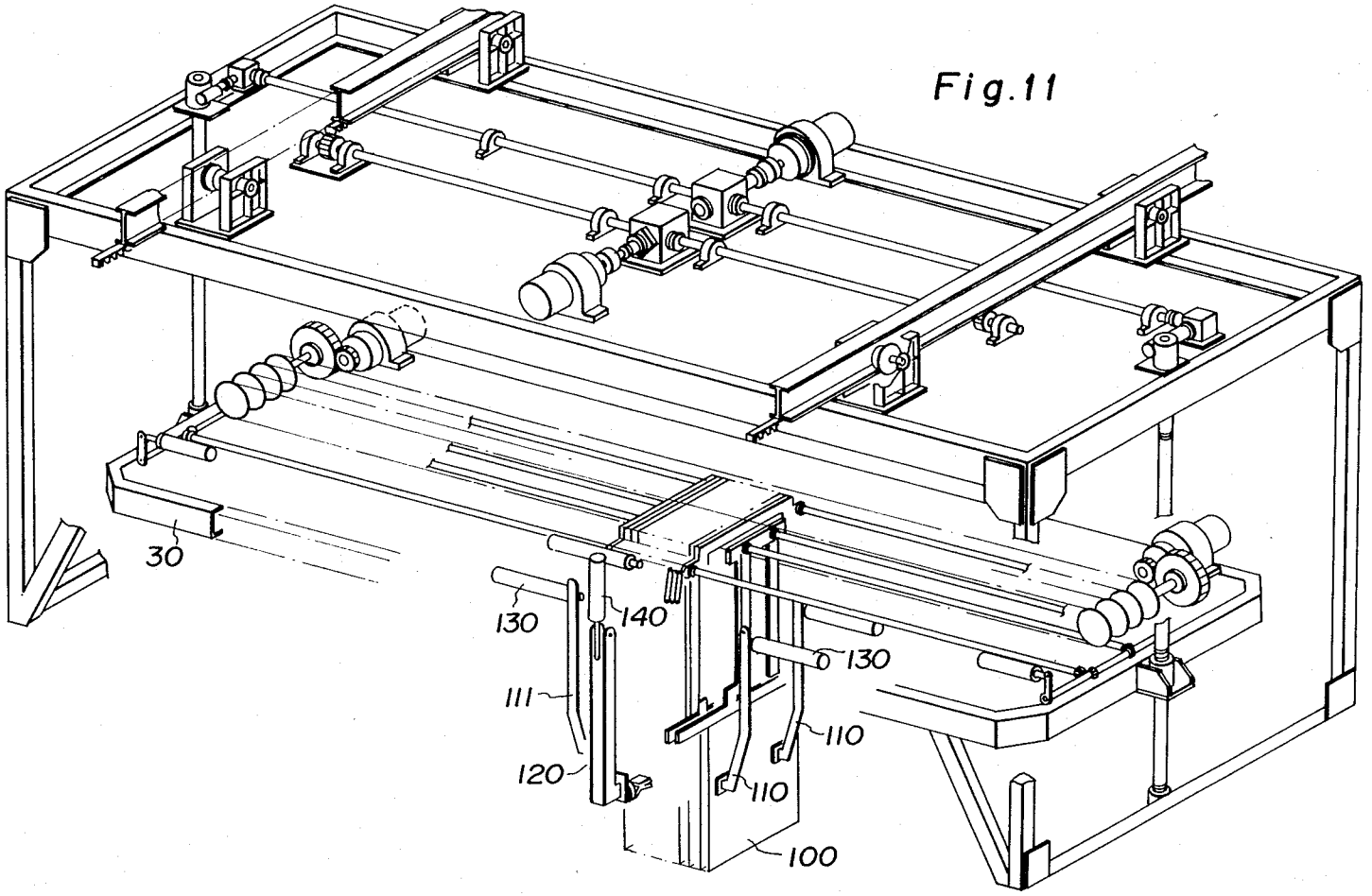
Figure 12:
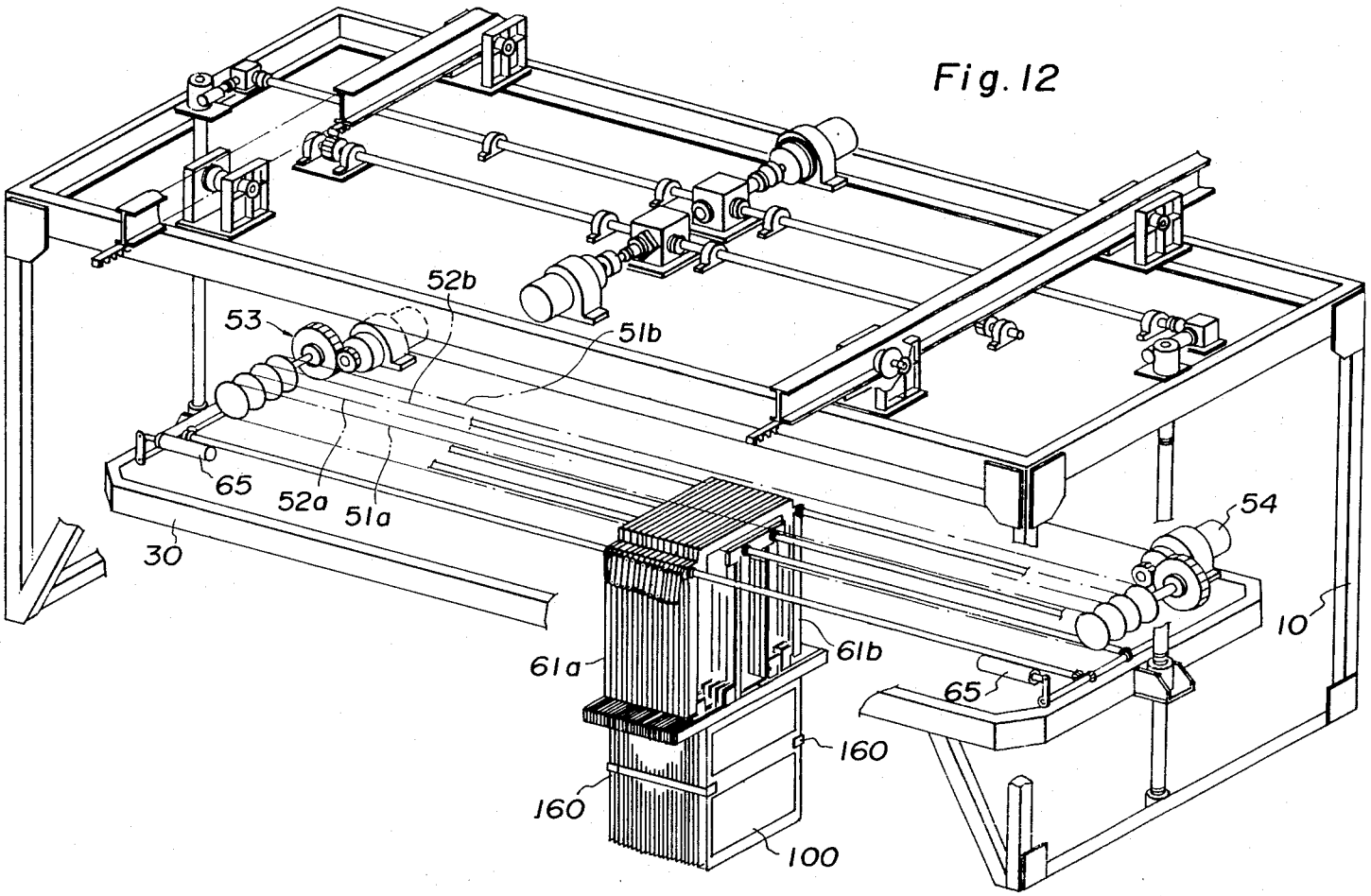

The above-described two pairs of the clamp arms 110, 111 are lifted to the underside of the beam 30 in the stand-by condition while the hangers 41, 42 move carrying the electrode plates 100 as shown in FIG. 10. When the hangers 41, 42 are moved toward the center of the hanger-supporting frame 30 and brought together, the clamp arms 110, 111 are lowered toward the electrode plates by means of the cylinder mechanism 130 as shown in FIGS. 11 and 12. The clamp arms clamp the electrode plates and tighten them. Needless to say, the anode plates and cathode plates are insualted and fixed by means of a frame.

Figure 14:
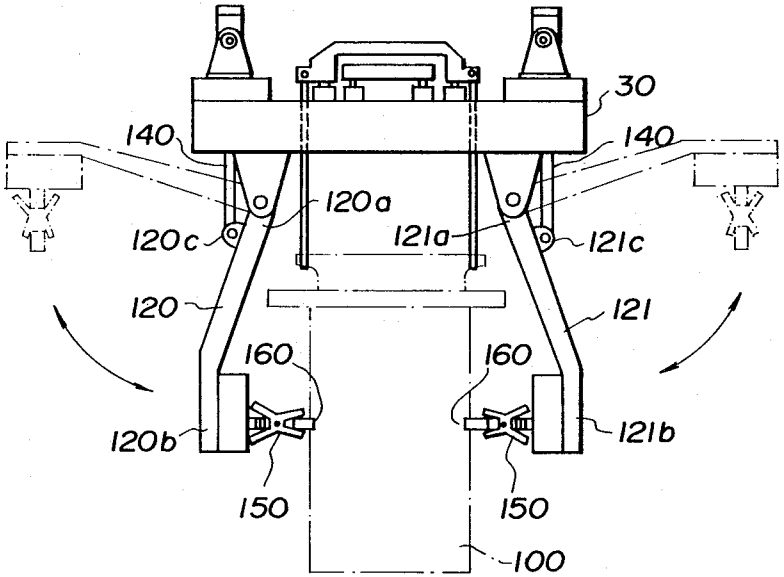
FIG. 14 is a partial side elevational view showing the second clamp means (holder arms).
Figure 15:
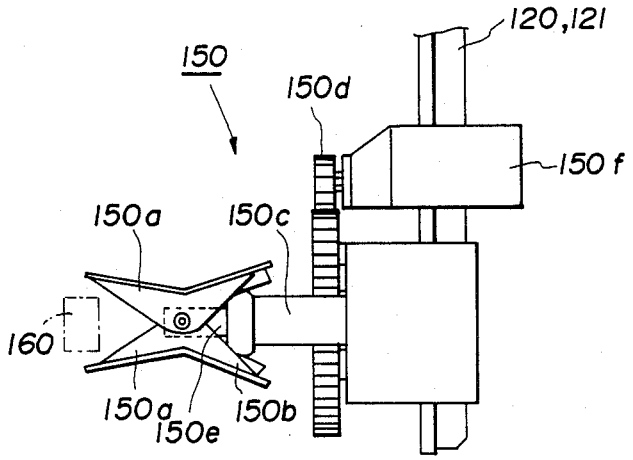
FIG. 15 is an enlarged partial side view showing clamp bar holder.
Figure 16:
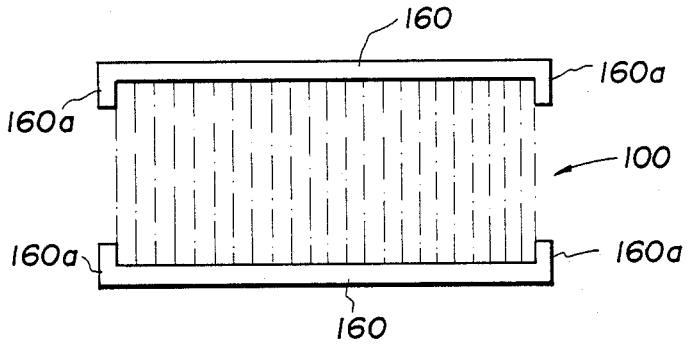
FIG. 16 is a partial plan view showing clamp bars.

In the direction perpendicular to the above-described clamp arms 110, 111, a pair of holder arms 120, 121 are provided on the hanger-supporting frame 30 as shown in FIG. 14. In the same manner as in the case of the clamp arms 110, 111, the base end of each holder arm 120*a*, 121*a* is pivotably secured to each opposite side beam of the hanger-supporting frame 30 and the holder arms are driven by cylinder mechanism 140 secured on the underside of the beam 30 via pins 120*c*. The other end of the holder arms 120*b*, 121*b* extend to the side of the electrode plates 100 and are provided with a clamp bar holder 150 respectively. The ends of the holder arms 120, 121 face the side edges of the electrode plates when they are lowered utmost. The clamp bar holder 150 a clip means as shown in FIG. 15 comprising a pair of pivoted lever members 150*a*, a supporting shaft 150*e*, a resilient means 150*b* which tends to open the distal ends of the lever members 150*a*, a pushing member 150*c* which closes the distal ends of the lever members 150*a* overcoming the resistance to the resilient means 150*b* and a drive motor 150*f* which drives the pushing member 150*c* via gear mechanism 150*d*. The clip means (lever members) 150*a* detachably holds a clamp bar 160. The clamp bar is a rod-like member which extends to a length corresponding to the total thickness of the bundled electrode plates and has a claw 160*a* at each end to hold the bundle of the electrodes as shown in FIG. 16. The pair of the holder arms 120, 121 are also located outside of the travelling course of the hangers 41, 42.

The holder arms 120, 121 respectively holding a clamp bar are held opened sideway in the stand-by condition while the hangers 41, 42 move carrying the electrode plates as shown in FIG. 10. When the hangers are moved to the center of the hanger-supporting frame 30 bringing the electrode plates together and the clamp holders 110, 111 tighten the electrodes plates as shown in FIG. 11, the holder arms 120, 121 are lowered toward the bundle of the electrode plates as shown in FIG. 14. and the clamp bars 160 flush the edges of bundled electrode plates 100 and clamp the electrode plates. After the clamp bars have clamped the bundled electrode plates, the holder arms 120, 121 release the clamp bars and are returned to the initial stand-by position. The bundled and clamped electrode plates are hung by the hangers and transferred to any desired station.

The disengagement of the clamp bars is effected by the reversing the aforesaid procedures. The holder arms are lowered from the stand-by positions and clasp the clamp bars 160, detach them from the electrode plates and are lifted again to the stand-by positions. The electrode plates are made free by the detachment of the clamp bars.

Figure 18:
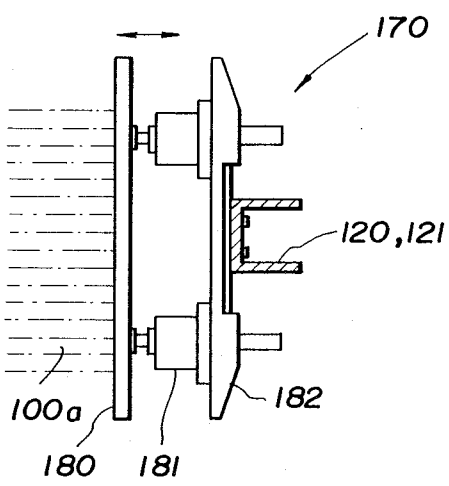
FIG. 18 is a partial plain view showing flushing of the edges of the plate members brought together by means of a clamp bar.
Figure 17:
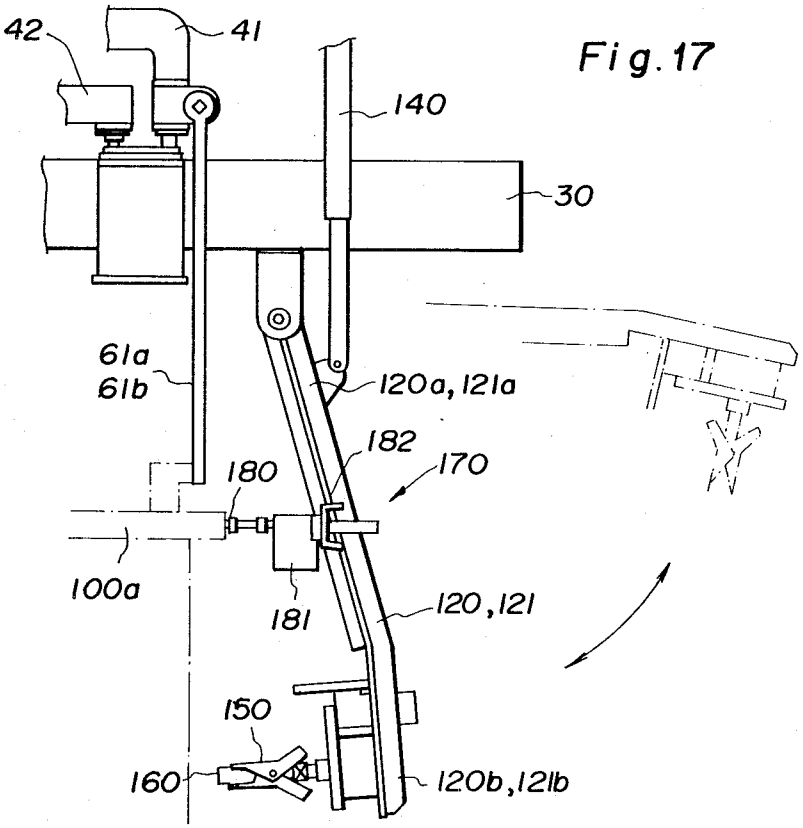
FIG. 17 is a partial elevational view showing movement of the second clamp means.

FIG. 17 shows another embodiment of the holder arm. The structures of the base end 120*a*. 121*a*, the distal ends 120*b*, 121*b* and the holder per se 150 are the same as in the embodiment represented by FIG. 13. This embodiment is characterized by being provided with an electrode-plate flushing mechanism 170. As shown in FIGS. 17 and 18, the plate-edge flushing mechanism 170 comprises a pusher 180 which touches the edges of the cross bars of the electrodes, a supporting member 181 which resiliently holds said pusher 180 and a frame 182 supporting the supporting member 181, which frame is secured to the holder arm 120, 121.

After a plurality of electrode plates 100 are tightened by the clamp arms 110, 111, the holder arms with the flushing mechanism 170 are lowered so that the pusher 180 touch the head bars and the positioning bars press the cross bars 100*a* of the electrodes from both sides so as to flush the edges thereof. The holder arms 120, 121 are moved toward the electrode plates 100, and thus the clamp bars 160 are fixed. Thereafter, the pushers 180 retract from the cross bars 100*a*. When the clamp bars are disengaged, the pushers are held at the retracted positions beforehand. The aforesaid clamp arms operate so as to tighten the bundled electrodes. Thereafter, the holder arms 120, 121 are lowered and hold the clamp bars and detach them from the edges of the bundled electrode plates and are returned to the stand-by position with them. The clamp arms are also returned to the stand-by position.

The apparatus of the present invention is used, for example, for handling the electrodes for an electrolytic cell as follows. The apparatus is first moved to an electrolytic cell by means of the driving means 20 and the travelling mechanism and stands still there. The hanger structure 30 is lowered so that the hooks 61*a*–62*b* reach the ears of the cross bars of the electrode plates 100. The hooks are tilted so as to catch the ears 100*b* by means of the rotatable rods 63*a*, 63*b*. The hanger-supporting frame 30 is lifted hanging a plurality of electrode plates from the electrolytic cell. The holder arms 120, 121 are lowered and hold the clamp bars 160 which have clamped the electrode plates and disengage them from the electrode plates. Then, the framework 10 moves to an electrode treating station, during which the hangers 41, 42 are spaced apart by means of the chain mechanism 51, 52. The hanger structure 40 carries the electrode plates 100 to stations for servicing, cleaning, etc. of the anodes, stripping, polishing, etc. of the cathodes, etc. as required. After the necessary treatments of the electrodes have been finished, the hangers are again brought together to the central portion by the chain means 51, 52. The clamp arms 110, 111 are lowered to tighten the electrode plates and further the holder arms 120, 121 are lowered to attach the clamp bars 160 to the bundled electrode plates. The holder arms then release the clamp bars. Thus the clamp arms 110, 111 and the holder arms 120, 121 are lifted to the stand-by positions, and the hangers also release the electrode plates and the hanger structure is lifted leaving the electrodes in the electrolytic cell. The operation is repeated as required.

Needless to say, the above-described operation can be automatically controlled by a known automation technique.

We claim:

1. An apparatus for suspending, lifting, lowering and carrying a plurality of plate members which are disposed in a face to face relation, said apparatus comprising:

a traveling framework provided with a driving means therefor;

a hanger structure which is movably mounted on said framework and has a hanger-supporting frame;

a plurality of hangers which are respectively provided with hook means to catch said plate members and which are slidably mounted on said hanger-supporting frame so that said hangers are spaced apart from each other or brought together hanging said plate members;

tilting means for tilting simultaneously a plurality of said hook means;

driving means for sliding said hangers; and driving means for lifting and lowering said hanger structure.

2. The apparatus described in claim 1, which is used for handling the electrode plates for electrolytic cells for electrowinning of metals, wherein the hook means extend downward from both ends of each hanger so that they can catch ears or the ends of the cross bars of the electrode plates.

3. The apparatus described in claim 2, wherein an insulating member is interposed between the hangers and the hanger-supporting frame and the hangers can hang the electrode plates of different kinds simultaneously.

4. The apparatus described in any claim of claims 1, 2 or 3, wherein the hangers are serially linked together by means of link mechanism, can be moved as a linked whole and can be spaced apart or brought together.

5. The apparatus described in claim 1, 2 or 3 wherein at least two chain mechanisms are provided which can draw the hangers in two opposite directions.

6. A hanger structure upon which hangs a plurality of plate members in a face to face relation, and which expands and reduces the spaces between said plate members comprising:

a hanger-supporting frame;

a plurality of hangers arranged in a row which are respectively provided with hook means to catch said plate members and which are slidably mounted on said supporting frame to be spaced apart from each other or brought together in the direction of the row of said plate members;

a driving means for sliding said hangers on said supporting frame; and a tilting means for tilting simultaneously a plurality of said hook means.

7. The apparatus described in claim 6, wherein the hanger structure comprises a plurality of outside hangers and a plurality of inside hangers, each outside hanger has a leg at each end so that it can encompass an inside hanger between its legs, and the inside hangers can travel under and inside the outside hangers along with the latter.

8. The apparatus described in claim 7, wherein the hanger-supporting frame is provided with at least one pair of clamp arms and a driving means therefor, the base end of the clamp arm is pivotably secured to the hanger-supporting frame so that the arms extend in the direction of the thickness of the electrodes and is rotatable so that the distal ends of the clamp arms hold both sides of a plurality of elecrode plates and tighten a bundle of the electrode plates, said clamp arms being provided inside of the hook members lest they should prevent the movement of the hangers.

9. The apparatus described in claim 8, wherein the hanger-supporting frame is provided with at least one pair of holder arms which are pivotably secured to the hanger-supporting frame in the direction perpendicular to the pair of the clamp arms and driving means therefor, each holder arm releasably holds a clamp bar which can clamp a plurality of bundled electrode plates, and the holder arms can be rotated toward the bundled electrode plates to make the clamp bar clamp the bundled electrode plates and release it.

10. The apparatus described in claim 9, which can stop at an electrolytic cell, lower the hanger-supporting frame, rotate the hook members to catch the ears of the electrode plates, lift the hanger-supporting frame with the electrodes from the electrolytic cell, disengage the clamp bars which have clamped the electrode plates by operation of the holder arms, locomoting the framework, spacing apart the hanging electrode plates before, during or after the locomotion, subjecting the hanging electrode plates to various treatments. bringing the hanging electrode plates together to the central portion of the hanger-supporting frame, tighten the electrode plates brought together and align and clamp the bundled electrode plates by means of the clamp arms and the holder arms, and finally lower the hanger-supporting frame in order to immerse the bundled electrode plates in an electrolytic cell.

* * * * *